United States Patent [19]

Crossland et al.

[11] 4,032,459

[45] * June 28, 1977

[54] LUBRICATING COMPOSITIONS CONTAINING HYDROGENATED BUTADIENE-ISOPRENE COPOLYMERS

[75] Inventors: Ronald K. Crossland; David J. St. Clair, both of Houston, Tex.

[73] Assignee: Shell Oil Company, Houston, Tex.

[ * ] Notice: The portion of the term of this patent subsequent to June 22, 1993, has been disclaimed.

[22] Filed: Jan. 29, 1976

[21] Appl. No.: 653,330

[52] U.S. Cl. ..... 252/51.5 A; 252/56 R; 252/59

[51] Int. Cl.[2] ..... C10M 1/32

[58] Field of Search ..... 252/51.5 A, 56 R, 59

[56] References Cited

UNITED STATES PATENTS

| | | | |
|---|---|---|---|
| 3,215,632 | 11/1965 | Hughes et al. | 252/51.5 A |
| 3,554,911 | 1/1971 | Schiff et al. | 252/59 |
| 3,600,311 | 8/1971 | Naiman et al. | 252/59 |
| 3,772,196 | 11/1973 | St. Clair et al. | 252/59 X |
| 3,795,615 | 3/1974 | Pappas et al. | 252/59 |
| 3,835,053 | 9/1974 | Meier et al. | 252/59 |
| 3,910,856 | 10/1975 | Kruka et al. | 252/59 X |
| 3,959,161 | 5/1976 | Dawans et al. | 252/59 |
| 3,965,019 | 6/1976 | St. Clair et al. | 252/59 |

*Primary Examiner*—Delbert E. Gantz
*Assistant Examiner*—Andrew H. Metz
*Attorney, Agent, or Firm*—Dean F. Vance

[57] ABSTRACT

Novel lubricating compositions are provided comprising a lubricating oil modified with a pour point depressant and as a superior viscosity index improver, a copolymer of butadiene and isoprene having between 20–55% 1,4-configuration, this polymer then having been hydrogenated to remove substantially all of the olefinic unsaturation.

8 Claims, No Drawings

LUBRICATING COMPOSITIONS CONTAINING HYDROGENATED BUTADIENE-ISOPRENE COPOLYMERS

BACKGROUND OF THE INVENTION

This invention relates to polymeric oil additives and especially to lubricating oil compositions containing these compounds. More particularly, the present invention relates to certain hydrogenated copolymers of butadiene with isoprene and optionally with a monoalkenyl arene, these copolymers designed to synergize or cooperate with pour point depressants which also are present.

A number of copolymers of dienes and olefins have been described in the literature, such as those mentioned in U.S. Pat. No. 3,795,615 and in the art further referred to in that patent. Moreover, superior viscosity index improving agents are disclosed in U.S. Pat. No. 3,772,196. This patent shows block copolymers of styrene and isoprene which have been hydrogenated in the isoprene block.

There is an economic incentive to investigate other polymers and copolymers which could be effective viscosity index improving agents, since the price of isoprene is increasing and the industrial supply thereof is shrinking. While study of use of butadiene in place of isoprene would appear to be logical in finding a substitute for isoprene in such copolymers, it has been found that copolymers containing butadiene as the sole diene, even though later hydrogenated, have a number of short comings. For example, if the 1,4-configuration of the polymer prior to hydrogenation is particularly high, then the resulting hydrogenated polymer strongly resembles polyethylene. It is known that polyethylene dissolves to only a very small extent in lubricating oil and therefore the polymer content is limited to such an extent that very little viscosity index improving effect can in fact be experienced.

The prior art patent referred to above namely U.S. Pat. No. 3,795,615, sought to modify this solubility feature by copolymerizing a certain amount of isoprene together with butadiene (either with or without styrene) and hydrogenating the resulting copolymer. This patent discloses and claims, however, only those copolymers in which the unhydrogenated copolymer had a 1,4-content between about 75–95%.

It has been found in investigations leading to the present invention that, while these polymers have a certain use in lubricating oils, this is clearly limited to those situations in which cold temperatures are not encountered. When the precurser polymer has such a high 1,4-content as this patent claims, the resulting hydrogenated derivative has been found to give unsatisfactory low temperature results. This is clearly reflected in the Brookfield viscosity of compositions containing such polymers and more particularly in the pour points of compositions containing them. Brookfield viscosity has been found to reflect the pumpability of oil at any given temperature while the pour point indicates that temperature at which wax commences to crystallize from the composition, whether or not a pour point depressant is present.

It is an object of the present invention to provide improved lubricating compositions. It is a particular object of the present invention to provide lubricating compositions having an improved viscosity index associated with useful low temperature properties. Other objects will become apparent during the following detailed description of the invention.

Now, in accordance with the present invention, an improved lubricating composition is provided comprising a major amount of a lubricating oil modified with an effective minor amount of a pour point depressant and, as a viscosity index improving agent, between about 0.4–4% by weight based on the lubricating oil of a hydrogenated copolymer of butadiene and isoprene wherein the weight ratio of butadiene to isoprene is between about 10:90–70:30, from about 30% to about 55% of the precursor copolymer units are in the 1,4-configuration and wherein the olefinic bonds are substantially saturated by hydrogenation, the average molecular weight of the copolymer being from about 40,000 to about 225,000.

The present invention contemplates the use of copolymers which may be described as random, tapered or block copolymers. Thus the most simple copolymer will be a random copolymer of butadiene and isoprene which is subsequently hydrogenated. If a monoalkenyl arene component is present as well as the two diolefins, this may be randomly disposed throughout the polymer chains or may comprise a tapering component or may constitute a separate polymer block. In the latter case, the diene block may in its turn be either random, tapered or a pair of diene blocks as long as the average 1,4-content of the diene component lies between about 20–55%.

The usual monoalkenyl arene monomers which may be employed are styrene, alpha-methylstyrene and tertiary-butylstyrene vinyl toluene (isomers). The methods for the synthesis of these compolymers are well known in the polymerization art. It is preferred that anionic polymerization be utilized since this results in copolymers having a relatively narrow molecular weight range. More particularly, it is preferred that the anionic polymerization rely upon lithium initiators and more particularly upon lithium alkyl initiators, such as secondary butyl lithium.

If a tapered polymer is desired, this is achieved by simply mixing the copolymerizable monomers, disposing them in an inert solvent such as an olefin or paraffin or mixture thereof and polymerizing as is well known. The degree of randomizing may be controlled by limited modification of the solvent with a polar additive such as an ether, a secondary amine or well known randomizing agents. The precise amount of randomizing agent does not form a part of the present invention since this is a matter known in the polymerization art. For example, between about 3 and 15% of a dialkyl ether such as diethylether will cause the formation of a highly random copolymer which has a relatively low 1,4-configuration, i.e. between about 30–55% on the average in the diene components. It is noteworthy that the 1,4-content of the isoprene components on the one hand and of the butadiene components on the other may differ substantially from one another, but the present invention is defined in terms of the average of these two figures. Block copolymers are well known in the polymer art and methods for their formation are shown in such patents as U.S. Pat. No. 3,772,196. Briefly, block copolymers are generally formed by sequential addition of two or more of the copolymerizable monomers. For example, a first block of polystyrene may be formed by homopolymerization of styrene with a lithium initiator. A diene is then added, such as butadiene, either alone or together with the copolymerizable isoprene component. On the other hand, sequential addition of the individual monomers may continue with homopolymerization of either isoprene or butadiene followed by sequential addition of the second diene component.

It is preferred that the weight ratio of butadiene to isoprene be between 65:35 and 45:55. The proportion of monoalkenyl arene, if any, is not critical but is preferred that it be restricted to about no more than 25 moles percent based on the total monomers forming the copolymer. Following the solution copolymerization as briefly referred to above, the copolymer is hydrogenated and then recovered for use in the lubricating compositions. It is possible at this point to incorporate a limited amount of lubricating oil prior to removal of the solvent so as to recover an oiled copolymer which has been found to disperse more easily in the lubricating oil composition. The oiled copolymer may be sold as an article commerce to lubricating oil compounders.

When the copolymers have been formed, it is then necessary to hydrogenate the olefin double bonds. This can be done by known processes which may involve the use of catalysts such as Raney nickel and the like, or more preferably, transition metal catalysts, such as cobalt or nickel carboxylates reacted with an aluminum alkyl compound. Such hydrogenation processes are well known in this art. Hydrogenation is carried out under condition which will substantially saturate at least about 95%, and preferably more, of the olefin double bond without any appreciable hydrogenation of any monoalkenyl arene unsaturation which may be present.

The pour point depressants utilized in conjunction with the hydrogenated copolymers as defined above are employed primarily for their pour point depressing effect although many of them may act as viscosity index improvers or thickeners. However, since they are employed in a minor pour point depressing amount, such as 0.1–2.5%, their proportion is normally too small to have an appreciable effect upon oil properties other than pour point. It is essential that the pour point depressent be present since the copolymers defined above exhibit essentially little pour point depressant function. On the other hand, one of the primary characteristics of the above class of copolymers is their outstanding and effective response to added pour point depressants particularly as distinguished from the response which is found from hydrogenated copolymers of butadiene and isoprene having 75% or higher 1,4-content in the precursor copolymer.

The pour point depressants especially contemplated here are well known high molecular weight copolymers of alkyl acrylates or alkyl methacrylates as well as nitrogen-containing acrylic esters. By the term "acrylic esters" is meant esters of acids of the acrylic acid series, including both acrylic acid and methacrylic acid.

The nitrogen-containing acrylic acid polymers as defined, can be prepared by any suitable means such as described in U.S. Pat. No. 3,215,632. These include nitrogen-containing polymers such as copolymers of vinylpyridine and $C_{8-30}$ alkyl methacrylates having a molecular weight range of 15,000 to 2,000,000, preferably between 200,000 and 850,000. This includes a preferred which is a copolymer of about 25% 2-methyl-5-vinylpyridine and 75% stearylmethacrylate with a molecular weight of about 200,000. Another suitable preferred species is a copolymer of about 30% stearylmethacrylate, 51% laurylmethacrylate, 14% methylmethacrylate and 5% 2-methyl-5-vinylpyridine with a molecular weight of about 600,000.

The oil component of the lubricating compositions according to the present invention is especially designed for the preparation of multigrade lubricants although single grade lubricants may be compounded as well. The types of oils are further defined in U.S. Pat. No. 3,772,196 and include oils useful particularly for the lubrication of internal combustion engines including diesel engines and gasoline engines as well as for the operation of other motor components such as in gear boxes and the like.

One of the primary aspects of the present invention has been referred to hereinbefore briefly. This comprises the discovery of the unique capability of these compositions to provide lubricants having low temperature properties in that the special hydrogenated copolymers of this invention coordinate with the pour point depressant to result in lubricating compositions having exceptionally low pour points. This appears to be due to the relatively low 1,4-content of the hydrogenated copolymer precursors as distinguished from the prior art copolymers which had at least 75% 1,4-content in the precursor copolymer. As the data given hereinafter will show, the latter type of prior art copolymer not only did not respond to the pour point depressant, but also the resulting lubricating compositions had unacceptably high Brookfield viscosities indicating their undesirable features showing poor pumpability.

The basic composition as described above may be used as such but preferably as modified by the presence of supplemental additives, combined with the hydrogenated copolymer and pour point depressant to provide the necessary stability, detergency, dispersancy, antiwear and anti-corrosion properties required of modern lubricants according to increasingly severe automotive specifications. These supplementary additives do not form a part of the present invention and furthermore are well known in the lubricating art and are well identified in prior art patent such as U.S. Pat. No. 3,772,196.

A preferred formulation incorporating the present invention is as follows:

| Components | Percent by Weight |
|---|---|
| Hydrogenated copolymer | 0.4–10 |
| Pour Point Depressant | 0.1–5 |
| Oil Soluble Metal Thiophosphate | 0.1–0.3 |
| Ashless Detergent | 0.1–8.5 |
| Over Based Alkylene Earth Metal | 0.05–3.5 |
| Alkaryl Sulfonate (bases sulfated ash) | |
| Oil | Balance |

The following examples illustrate the preparation of hydrogenated copolymers of the present invention and comparison of these with prior art copolymers as lubricating oil additives. The copolymers of the examples were prepared under the following conditions:

EXAMPLE I

Copolymer of the Present Invention

A hydrogenated copolymer of butadiene and isoprene was prepared having the following analysis:

| | |
|---|---|
| Mol Weight | 64,000 |

-continued

| | |
|---|---|
| Percent Weight Butadiene | 62 |
| Percent Weight Isoprene | 38 |
| Percent 1,4-Butadiene | 59 |
| Percent 1,4-Isoprene | less than 10 |

This copolymer was prepared by continuous addition of a mixture of isoprene and butadiene to cyclohexane containing 7% by weight of diethyl ether, using secondary butyl lithium as the catalyst. Polymerization was conducted for 2 hours at 45° C. The resulting copolymer was essentially completely hydrogenated by the process and catalyst as described in U.S. Pat. No. 3,595,942.

EXAMPLE II

Preparation of High 1,4-Content Copolymer According to U.S. Pat. No. 3,795,615

A copolymer was prepared by the process described in Example II of the above patent for comparison with the copolymer of the present invention prepared as described in Example I above. The prior art polymer from Example II of the patent U.S. Pat. No. 3,795,615 had the following properties molecular weight, 49,000; percent weight butadiene, 62; percent weight isoprene, 380; percent 1,4-butadiene, 91; percent 1,4-isoprene, 90. The polymer was hydrogenated using the same conditions as in Example I, to reduce the olefin unsaturation to substantially zero. The data in Table I show striking differences in viscosity index effectiveness and in the response of the viscosity index improvers to pour point depressant. Example I, which illustrates the compositions of the present invention show that complete response is obtained to the pour point depression. Example II, representative of the closest prior art, shows that polymers prepared from high 1,4-content copolymers are deficient in two respects, namely in showing essentially no response to the pour point depressant additive and futhermore showing exceptionally poor Brookfield viscosities over the range of temperatures tested indicating that the latter composition exhibits poor pumpability of the oil.

Each of the samples contained 0.5% by weight of hitec E-672 manufactured by Edwin Cooper Company and understood to be a pour point depressant which is a copolymer of styrene and maleic anhydride esterified with fatty alcohols. The response to pour point depressants by the copolymer of Example II was just as poor when the pour point depressant was prepared from methacrylate polymers and terpolymers of methacrylates with vinylpyridines.

TABLE I

| Sample | Ex. I | Ex. II |
|---|---|---|
| % copolymer | 3.75 | 2.92 |
| 210° F kinematic viscosity, cs. | 16.34 | 16.6 |
| 100° F kinematic viscosity, cs. | 107.6 | 281.3 |
| Pour Point, ° F | −35 | +15 |
| Viscosity Index | 172 | 55 |
| Brookfield viscosity, cps. | | |
| at +20° F | 1330 | 8490 |
| 0° F | 4580 | 65000 |
| −20° F | 62580 | 100,000 |

We claim as our invention:

1. An improved lubricating oil composition comprising a major proportion of a hydrocarbon lubricating oil, a pour point depressing amount of a pour point depressant, and a viscosity index improving amount of a viscosity index improver, the improvement wherein said viscosity index improver comprises a hydrogenated copolymer of butadiene and isoprene wherein the weight ratio of butadiene to isoprene is between about 10:90 and 70:30 and from about 20 to about 55% of the precursor copolymer units are in the 1,4-configuration and wherein the olefinic bonds are substantially saturated during hydrogenation, the average molecular weight being between about 40,000 and about 225,000.

2. A composition according to claim 1 wherein the pour point depressant is a copolymer of $C_{8-30}$ alkyl methacrylate or a terpolymer of these with a vinyl pyridine.

3. The composition of claim 1 in which said hydrogenated copolymer contains up to 35 mol percent of a co-monomer comprising a monoalkenyl arene.

4. The composition of claim 1 wherein the weight ratio of butadiene to isoprene is between 65:35 and 45:55.

5. The composition according to claim 3 wherein the monoalkenyl arene is styrene.

6. The composition according to claim 1 wherein the copolymer is an essentially random copolymer.

7. The composition according to claim 3 wherein the copolymer comprises a polymer block of the monoalkenyl arene and a random copolymer block of butadiene and isoprene.

8. A composition according to claim 1 wherein the amount of viscosity index improver employed is from about 0.4 to about 4.0% by weight of the lubricating oil composition.

* * * * *